United States Patent [19]

Gilliland et al.

[11] Patent Number: 4,961,088

[45] Date of Patent: Oct. 2, 1990

[54] MONITOR/WARRANTY SYSTEM FOR ELECTROSTATOGRAPHIC REPRODUCING MACHINES USING REPLACEABLE CARTRIDGES

[75] Inventors: W. Keith Gilliland, Webster; Christian G. Midgley, Fairport; Francis W. Dana, Ontario, all of N.Y.; Mark C. Mutch, University Heights, Ohio

[73] Assignee: Xerox Corporation, Stamford, Conn.

[21] Appl. No.: 340,994

[22] Filed: Apr. 20, 1989

[51] Int. Cl.[5] ..... G03G 15/00

[52] U.S. Cl. ..... 355/206; 355/260

[58] Field of Search ..... 364/550, 525; 355/200, 355/204, 206, 209, 211, 260, 308

[56] References Cited

U.S. PATENT DOCUMENTS

| | | | |
|---|---|---|---|
| 4,500,195 | 2/1985 | Hosono | 355/3 R |
| 4,551,000 | 11/1985 | Kanemitsu et al. | 355/3 R |
| 4,585,327 | 4/1986 | Suzuki | 355/3 R |
| 4,586,147 | 4/1986 | Tadokoro | 364/550 |
| 4,634,258 | 1/1987 | Tanaka et al. | 355/4 |
| 4,751,484 | 6/1988 | Matsumoto et al. | 355/14 CU |
| 4,774,544 | 9/1988 | Tsuchiya et al. | 355/14 C |
| 4,851,875 | 7/1989 | Tanimoto | 355/209 X |

FOREIGN PATENT DOCUMENTS

| | | | |
|---|---|---|---|
| 60-229047 | 11/1985 | Japan | 355/308 |
| 62-102259 | 5/1987 | Japan | 355/308 |

*Primary Examiner*—Joan H. Pendegrass

*Attorney, Agent, or Firm*—Frederick E. McMullen

[57] ABSTRACT

A monitor/warranty system for electrostatographic reproducing machines in which replaceable cartridges providing a predetermined number of images are used, each cartridge having an EEPROM programmed with a cartridge identification number that when matched with a cartridge identification number in the machine enables machine operation, a cartridge replacement warning count, and a termination count at which the cartridge is disabled from further use, the EEPROM storing updated counts of the remaining number of images left on the cartridge after each print run.

12 Claims, 6 Drawing Sheets

MONITOR/WARRANTY SYSTEM FOR ELECTROSTATOGRAPHIC REPRODUCING MACHINES USING REPLACEABLE CARTRIDGES

BACKGROUND OF THE INVENTION

The present invention relates to electrostatographic reproducing machines, and more particularly to a monitor/warranty system based on the use of one or more replaceable cartridges.

Recently, electrostatographic reproducing machines have been developed which use one or more replaceable subassemblies, termed cartridges. One typical cartridge is the so-called Xerographic cartridge containing the machine photoreceptor and the necessary supporting hardware therefor assembled in a single unit designed for insertion and removal into and out of the machine. When the Xerographic cartridge is used up, the old cartridge is removed and a new one substituted. Other replaceable cartridges including developer cartridges, toner supply cartridges, etc., may also be envisioned for this purpose.

However, where the cartridge also serves as the vehicle for billing the customer for the number of prints or copies made, it becomes important that the cartridge not only reliably provide all the copies for which the customer has paid, but also that there be a reliable and fail safe way to control and monitor the cartridge's use. The customer should get exactly the number of prints guaranteed for the cartridge. If less, the manufacturer should make up the difference free of charge.

Also, the customer should get no more than the print number warranted. But since any customer would obviously find it advantageous to obtain more prints than he is supposed to get and can probably be expected to try and use the cartridge beyond the warranty stage, it is also important to the manufacturer to make sure, once all of the prints have been made and the cartridge is exhausted, that the cartridge is disabled and that no further prints can be made by the cartridge. The intent of this being to insure continued quality of the images.

Further, it is highly desirable that the customer be given a warning when the cartridge is close to the end of its life so that there is time for the customer to obtain a fresh cartridge before the old cartridge is used up. Additionally, in cases where the printer or copying machine is under warranty by the manufacturer, use of cartridges other than those made by the manufacturer must be prevented lest the manufacturer be burdened with the expense for repairs that otherwise would not have been necessary if the manufacturer's cartridge had been used.

PRIOR ART

In the prior art, U.S. Pat. No. 4,634,258 (Tanaka et al) discloses a color copier employing replaceable color toner developer containers. Counters in the machine, which record and display to the operator the number of copies made with each color toner developer container, allow the operator to keep track of the amount of color developer used for each container. In a similar vein, U.S. Pat. No. 4,551,000 (Kanemitsu et al) discloses a replaceable processing unit for copier having an external colored indicator to display the amount of service life remaining in the processing unit.

In addition, U.S. Pat. No. 4,585,327 (Suzuki) discloses a copier employing a removable magazine containing the machine photosensitive belt. A counter in the machine counts the number of copies made on the magazine and generates a signal on a preset count that warns the user that the service life of the photosensitive belt has come to an end. To prevent reuse of the same magazine, a part of the magazine is broken off when the magazine is first loaded into the machine that precludes resetting of the counter in the event a used magazine is inadvertently inserted.

Further, U.S. Pat. No. 4,751,484 (Matsumoto et al) discloses an image forming apparatus which records drum usage and stops the drum and renders the apparatus inoperable following making of a preset number of copies, while U.S. Pat. No. 4,500,195 (Hosono) discloses an image forming apparatus employing a replaceable copy subassembly. When a new unit is installed, the operating parameters of the apparatus are automatically re-adjusted in accordance with the built-in operating characteristics of the new unit. And, U.S. Pat. No. 4,774,544 (Tsuchiya et al), discloses a counter for an image forming apparatus in which the counter comprises an EEPROM, while U.S. Pat. No. 4,586,147 (Tadokoro) discloses use of an EEPROM for storing the operating history of a printer.

SUMMARY OF THE INVENTION

In contrast, the present invention provides a monitor/warranty system for electrostatographic machines such as printers and copiers in which one or more replaceable cartridges are used, each warranted to produce a certain number of images. The cartridges employ an improved cartridge monitor which prevents use of non-approved cartridges, continuously logs a count of the number of images made on the cartridge, and disables the cartridge from further use when the number of remaining images reaches a predetermined termination count.

More specifically, the invention provides a monitor/-warranty method for an electrostatographic reproducing machine having at least one replaceable cartridge warranted to produce a predetermined number of images, and an operating system for controlling operation of the machine including job programming means for programming image runs, the cartridge including an on-board memory for monitoring cartridge use, comprising the steps of: during each image run, counting the images produced; at the end of the run, accessing the cartridge memory to obtain a count of the number of previous remaining images; arithmetically updating the count with the count of images produced during the run; storing the updated count in the cartridge memory; comparing the updated count with zero; and where the updated count is equal to or less than zero, disabling the cartridge from further use.

The invention further provides a replaceable cartridge for a xerographic copying or printing machine for producing images comprising: a cartridge housing; at least one xerographic processing component operably disposed in the housing effective on assembly of the cartridge with the machine to enable the machine to process images; and a programmable memory in the housing for logging the number of images made on the cartridge, the memory being pre-programmed with a cartridge identification number for comparison with a cartridge recognition number in the machine on assembly of the cartridge with the machine whereby to restrict operation of the machine to only authorized cartridges.

The invention further provides a customer billing system for an electrostatographic copying or printing machine for producing images, the machine having an operating system for controlling operation of the machine, comprising, in combination: at least one replaceable cartridge for use in operating the machine, the cartridge having a limited operational life allowing the machine on installation of the cartridge to produce a preset number of images; the cartridge including a programmable memory for logging the number of images made on the cartridge; means for updating the count on the memory as images are produced by the machine; the memory being pre-programmed with a maximum count reflecting the maximum number of images that can be produced with the cartridge; the memory including means to permanently disable the memory from further use when the count on the memory reaches the maximum count, the operating system including means responsive to disabling of the memory to prevent the machine from producing images.

BRIEF DESCRIPTION OF THE DRAWINGS

Other features of the present invention will become apparent as the following description proceeds and upon reference to the drawings in which.

DESCRIPTION OF THE PREFERRED EMBODIMENT

The invention will now be described with reference to a preferred embodiment of the monitor/warranty system of the present invention using Customer Replaceable Units (CRUs) in the form of cartridges. Although the monitor/warranty system of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment shown herein.

Figure 1:
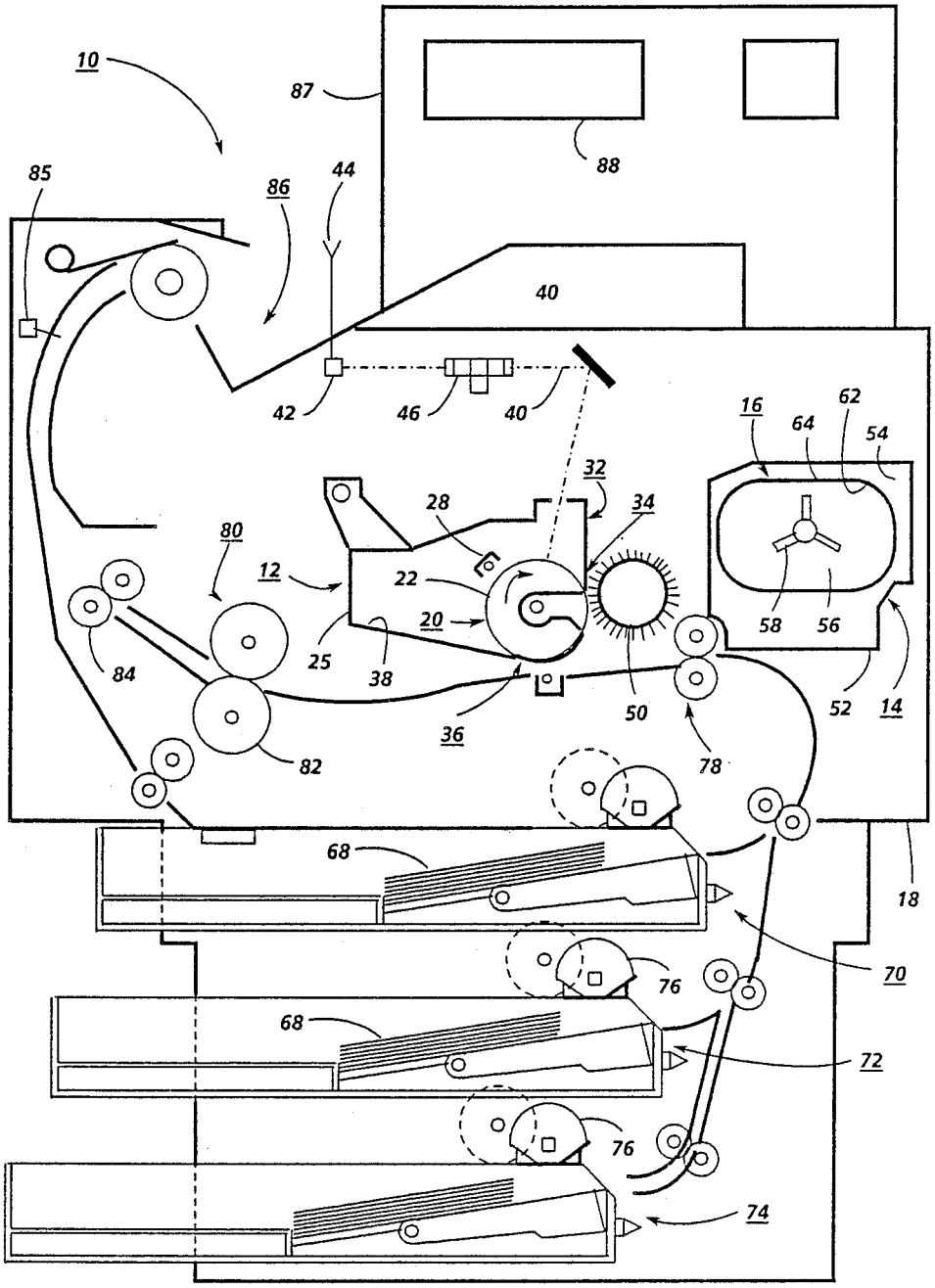
FIG. 1 is a schematic representation in cross section of an automatic electrostatographic reproducing machine having replaceable xerographic, developer, and toner cartridges, each monitored and warranted for a predetermined number of copies in accordance with the teachings of the present invention.
Figure 2:
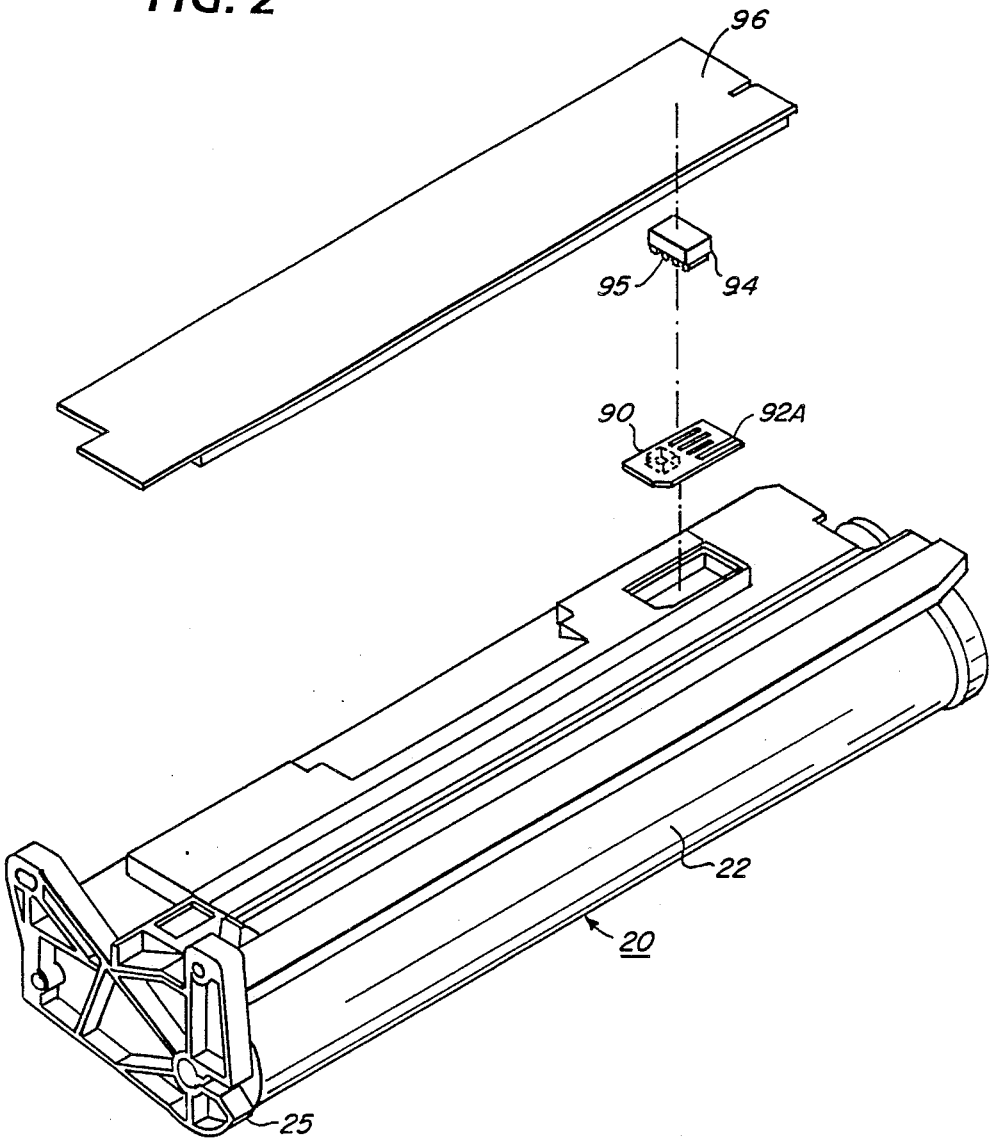
FIG. 2 is an isometric view showing details of the replaceable xerographic cartridge for the machine shown in FIG. 1 together with the mechanism for establishing electrical contact between the xerographic cartridge EEPROM and the machine control unit on insertion of the cartridge into place.
Figure 3:
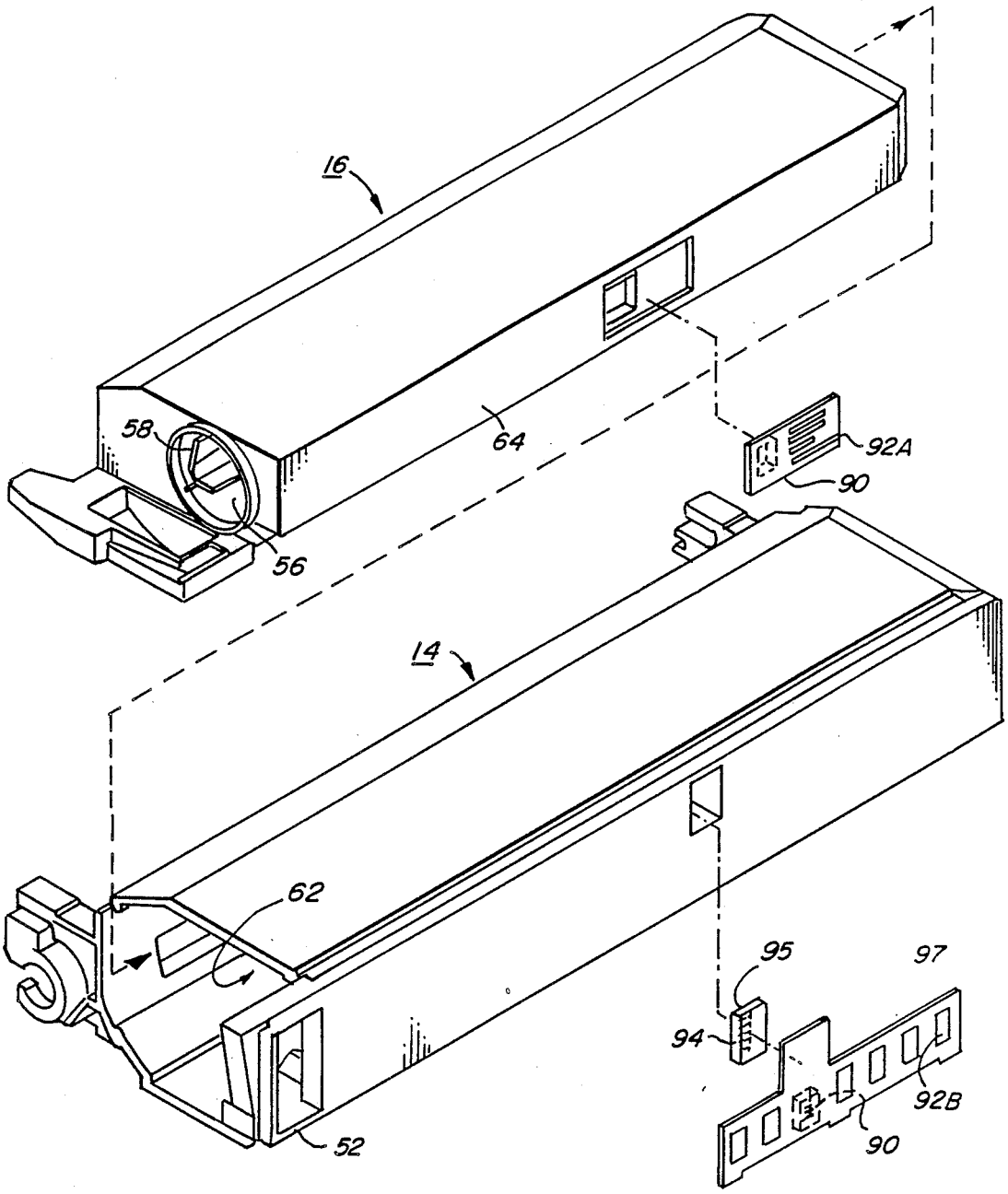
FIG. 3 is an isometric view showing details of the replaceable developer and toner cartridges for the machine shown in FIG. 1.

Referring now to FIGS. 1-3, there is shown by way of example an automatic electrostatographic reproducing machine 10 of the type adapted to implement the customer billing system of the present invention. In the example shown, reproducing machine 10 comprises a laser printer employing replaceable xerographic, developer, and toner cartridges 12, 14, 16 respectively, each of which is designed to provide a preset number of images in the form of prints or copies. And while machine 10 is exemplified in the ensuing description and drawings as a printer, other types of reproducing machines such as copiers, ink jet printers, etc. may be envisioned.

In the ensuing description, as will appear more fully, cartridges 12, 14, 16 are each warranted to produce a preset number of images (Y). When the number of remaining images reaches a predetermined level (X), a warning is given. This warning is to allow the customer time to order a new cartridge. After the above mentioned warning has been given, the machine will continue to make the last remaining images (X). At this point the total images (Y) have been made and the cartridge is disabled and further operation of machine 10 is prevented. At that point, the 'dead' cartridge 12, 14, or 16 must be removed and replaced by a new 'live' cartridge for further operation of machine 10.

Xerographic cartridge 12 includes a photoreceptor drum 20, the outer surface 22 of which is coated with a suitable photoconductive material, and a charge corotron 28 for charging the drum photoconductive surface 22 in preparation for imaging. Drum 20 is suitably journaled for rotation within the cartridge body 25, drum 20 rotating in the direction indicated by the arrows to bring the photoconductive surface thereof past exposure, developer, and transfer stations 32, 34, 36 of machine 10 on installation of cartridge 12 in the machine. To receive xerographic cartridge 12, a suitable cavity 38 is provided in machine frame 18, the cartridge body 25 and cavity 38 having complementary shapes and dimensions such that on insertion of cartridge 12 into cavity 38, drum 20 is in predetermined operating relation with exposure, developer, and transfer stations 32, 34, 36 respectively. With insertion of cartridge 12, drum 20 is drivingly coupled to the drum driving means (not shown) and the electrical connections to cartridge 12 made.

In the xerographic process practiced, the photoconductive surface 22 of drum 20 is initially uniformly charged by charge corotron 28, following which the charged photoconductive surface 22 is exposed by imaging beam 40 at exposure station 32 to create an electrostatic latent image on the photoconductive surface 22 of drum 20.

Imaging beam 40 is derived from a laser diode 42 modulated in accordance with image signals from a suitable source 44. Image signal source 44 may comprise any suitable source of image signals such as memory, document scanner, communication link, etc. The modulated imaging beam 40 output by laser diode 42 is impinged on the facets of a rotating multi-faceted polygon 46 which sweeps the beam across the photoconductive surface 22 of drum 28 at exposure station 32.

Following exposure, the electrostatic latent image on the photoconductive surface 22 of drum 20 is developed by a magnetic brush development system contained in developer cartridge 14. The magnetic brush development system includes a suitable magnetic brush roll 50 rotatably journaled in body 52 of cartridge 14, developer being supplied to magnetic brush roll 50 by toner cartridge 16. To receive developer cartridge 14, a suitable cavity 54 is provided in machine frame 18, cartridge body 52 and cavity 54 having complementary shapes and dimensions such that on insertion of cartridge 14 into cavity 54, magnetic brush roll 50 is in predetermined developing relation with the photoconductive surface 22 of drum 20. With insertion of cartridge 14, magnetic brush roll 50 is drivingly coupled to the developer driving means (not shown) in machine 10 and the electrical connections to cartridge 14 made.

Toner cartridge 16 provides a sump 56 within which developer comprising a predetermined mixture of carrier and toner for the magnetic brush development system in developer cartridge 14 is provided. A rotatable auger 58 mixes the developer in sump 56 and provides developer to magnetic brush roll 50. Magnetic brush roll 50 is suitably journaled for rotation in the body 52 of cartridge 16.

As seen best in FIG. 3, body 52 of developer cartridge 14 forms a cavity 62 for receipt of toner cartridge 16, cavity 62 of cartridge 14 and body 64 of cartridge 16 having complementary shapes and dimensions such that on insertion of cartridge 16 into cavity 62, cartridge 16 is in predetermined operating relation with the magnetic brush roll 50 in developer cartridge 14. With insertion of toner cartridge 16, auger 62 is drivingly coupled to the developer driving means (not shown) and the electrical connections to cartridge 16 made.

Prints of the images formed on the photoconductive surface of drum 20 are produced by machine 10 on a suitable support material, such as copy sheet 68 or the like. A supply of copy sheets 68 is provided in plural paper trays 70, 72, 74. Each tray 70, 72, 74 has a feed roll 76 for feeding individual sheets from the stack of sheets in tray 70, 72, 74 to a registration pinch roll pair 78. Following registration, the sheet is forwarded to transfer station 36 in proper timed relation with the developed image on drum 20. There, the developed image is transferred to the copy sheet 68. Following transfer, the copy sheet bearing the toner image is separated from the photoconductive surface 22 of drum 20 and advanced to fixing station 80 wherein roll fuser 82 fixes the transferred powder image thereto. A suitable sheet sensor 85 senses each finished print as the print passes from fixing station 80 to output tray 86. After fusing, the toner image to the copy sheet, the sheet 68 is advanced by print discharge rolls 84 to print output tray 86.

Any residual toner particles remaining on the photoconductive surface 22 of drum 20 after transfer are removed by a cleaning mechanism (not shown) in xerographic cartridge 12.

To control operation of machine 10, a suitable control panel 87 with various control and print job programming elements is provided. Panel 87 additionally includes a suitable message display window 88 for displaying various operating information to the machine operator.

Referring particularly to FIGS. 2 and 3, in order to assure that only authorized and unexpired xerographic, developer, and toner cartridges are used as well as to maintain running count of the number of images made with each cartridge and prevent further use when the cartridge is used up, each cartridge 12, 14, 16 has an identification/memory chip in the form of an Electrically Erasable Programmable Read Only Memory (EEPROM) 90 integral therewith. To enable EEPROMs 90 to be electrically connected and disconnected with the machine on installation or removal of the cartridges, contact pads 92A or 92B are provided. Terminal blocks 94 and a terminal board 97 are employed to complete the electrical connection between EEPROMs 90 and the machine control unit.

As seen in FIG. 2, the terminal block 94 for xerographic cartridge 12 is mounted on a part 96 of the cavity 38 within which xerographic cartridge 12 fits. On installation of xerographic cartridge 12, contact pads 92A of the xerographic cartridge EEPROM 90 engage contacts 95 of the terminal block 94 to complete the electrical connection to the EEPROM. As seen in FIG. 3, the terminal block 94 for toner cartridge 16 is mounted on terminal board 97. The EEPROM 90 for developer cartridge 14 is also mounted on board 97. Contact pads 92B on board 97 serve to electrically couple the EEPROM 90 of developer cartridge and, through the intermediary of terminal block 94, the EEPROM 90 of toner cartridge 16 to the machine control unit. On installation of toner cartridge 16 into the cavity 62 formed by developer cartridge 14, contact pads 92A of the toner cartridge EEPROM 90 engage contacts 95 of the terminal block 94 for toner cartridge 14 on board 97. On installation of the developer cartridge 14 into machine 10, contacts 92B for both the EEPROM 90 of toner cartridge 16 and the EEPROM 90 of developer cartridge 14 mate to a second set of contacts mounted on the machine frame 18 (not shown) to complete the electrical connection.

Figure 4:
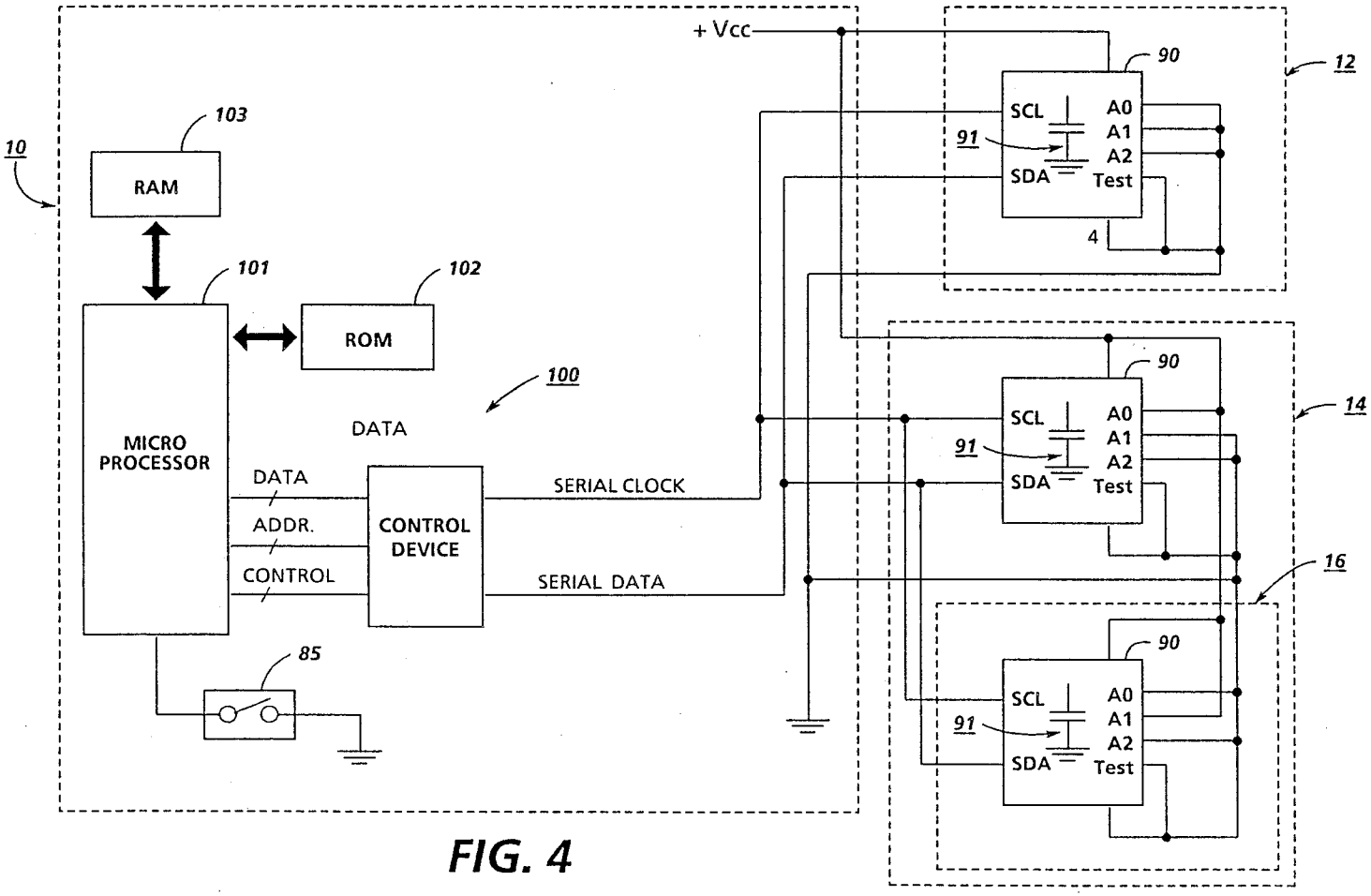
FIG. 4 is a control schematic showing details of the machine control unit and the coupling therewith with the EEPROMs of the xerographic, developer, and toner cartridges.

Referring now to FIG. 4, a suitable machine control unit (MCU) 100 which includes one or more microprocessors 101 and suitable memory, such as ROM and RAM memories 102, 103 respectively for holding the machine operating system software, programming data, etc., is provided, control unit 100 operating the various component parts of machine 10 in an integrated fashion to produce prints.

The EEPROMs 90 for each cartridge 12, 14, 16 provide addressable memory for storing or logging a count of the number of images remaining on each cartridge, the count being stored on the various EEPROMs 90 by control unit 100 at the end of each run. Each EEPROM is pre-programmed with a maximum count Y reflecting the maximum number of images that can be made by the cartridge. The counting system is a decrementing type system with the count Y in EEPROMs 90 being decremented as images are made to provide a current image count. When the current image count Y reaches a termination count which in the example described is zero, the cartridge is rendered unusable. To alert or warn the customer when the cartridge is nearing the end of life, a warning count X reflecting the predetermined number of remaining images left on the cartridge is also provided in EEPROMs 90. When the warning image count X is reached, a message is displayed in message display window 88 of control panel 87 to warn the operator that the cartridge currently in use is nearing end of life and should be replaced. Typically the warning count X provides a few hundred to a few thousand images within which the operator must obtain a replacement cartridge if continued operation of the machine is to be assured.

Maximum image count Y and the warning image count X are typically pre-programmed into the EEPROMs 90 at the factory. Additionally, in order to assure that only authorized EEPROMs are used, an identification number is pre-programmed and stored in the EEPROM for each cartridge 12, 14, 16.

Figure 5:
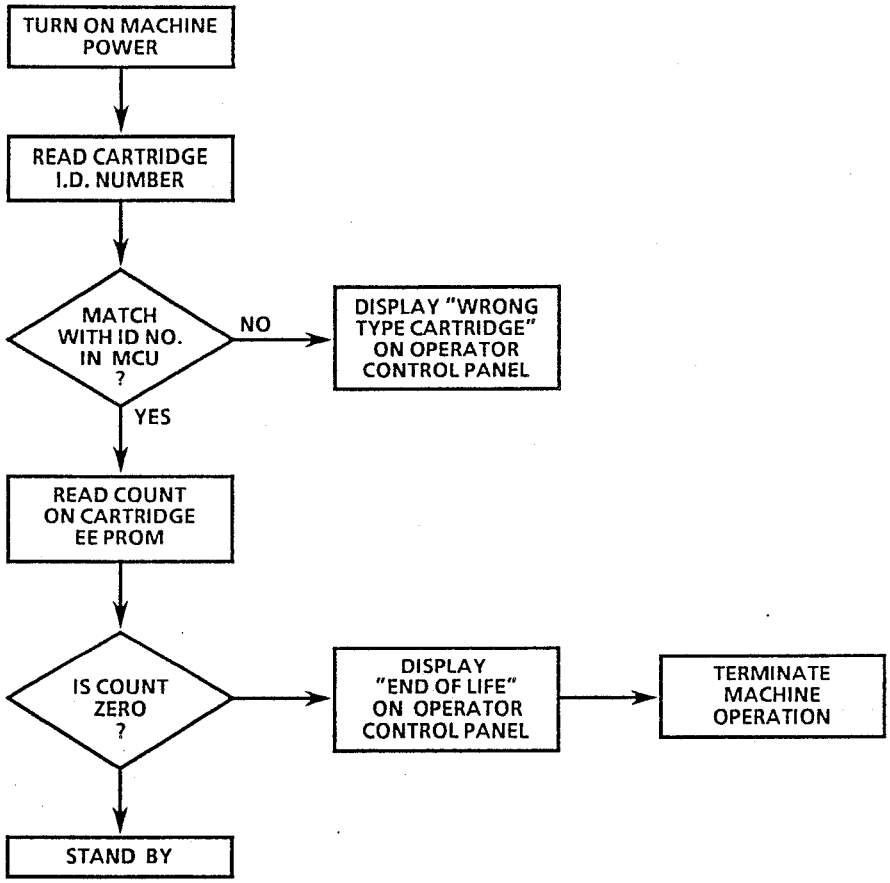
FIG. 5 is a flow chart depicting the machine initialization cycle in which cartridge identification and image counts are checked prior to enabling operation of the machine.
Figure 6:
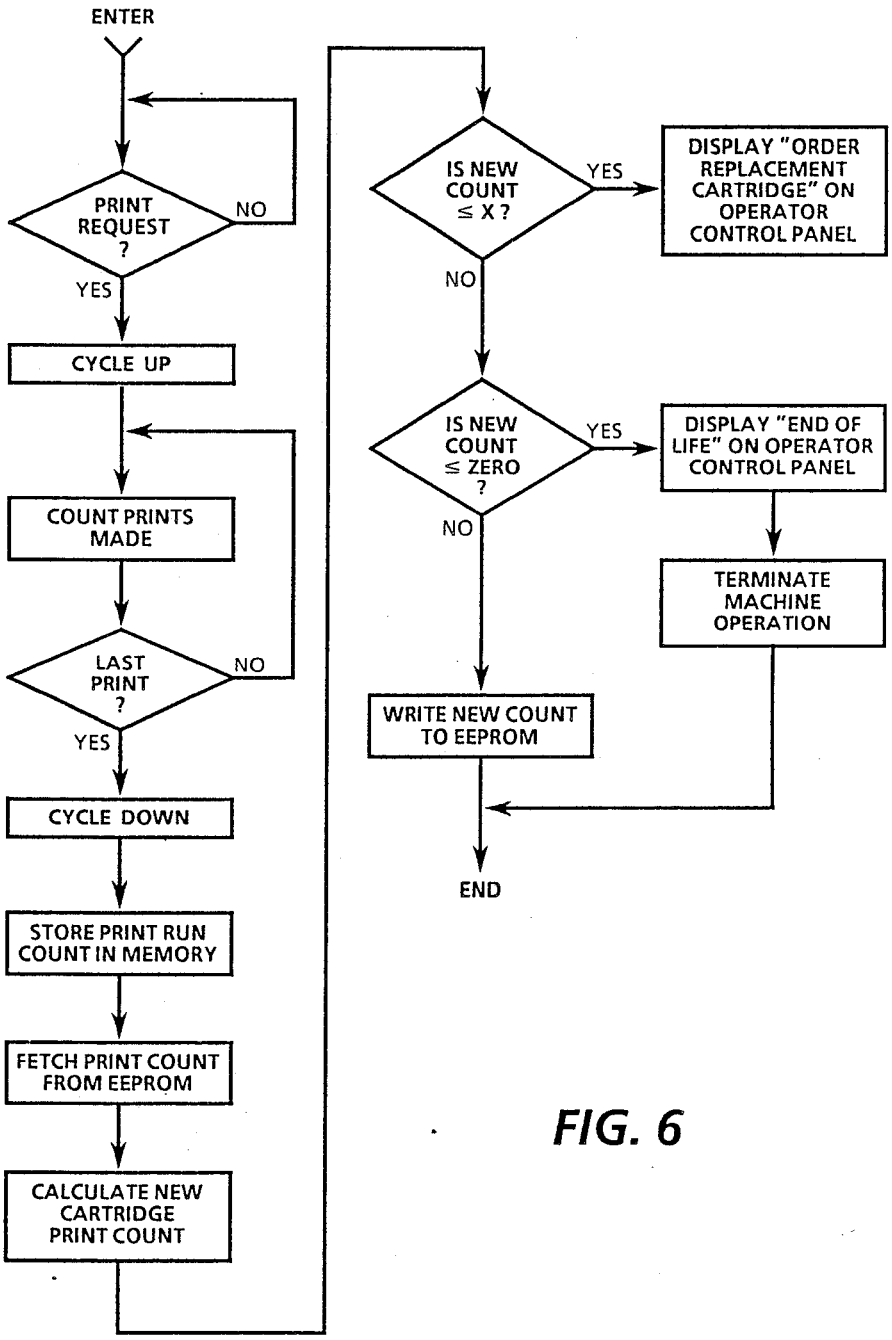
FIG. 6 is a flow chart depicting the image counting and cartridge count updating cycles.

Referring particularly to FIGS. 4–6, whenever machine 10 is powered up, an initialization routine is entered in which the identification numbers of cartridges 12, 14, 16 are read (READ CARTRIDGE I.D. NO.) and compared with the corresponding recognition numbers stored in ROM 102 (MATCH WITH I.D. NO. IN MCU?). Where the identification number of any cartridge does not match the recognition number for that cartridge, operation of machine 10 is prevented and the message (WRONG TYPE CARTRIDGE) is displayed in display window 88.

Presuming that the correct cartridges are installed, a check is made to see if the cartridges have reached the end of the cartridge life. For this, the current image count logged in each EEPROM 90 is obtained (READ COUNT ON CARTRIDGE EEPROM) and compared with the termination count, here zero (IS COUNT ZERO?). Where the current image count on the EEPROM is equal to or less than zero the cartridge is exhausted and the message (END OF LIFE) is displayed for the exhausted cartridge in display window 88. Operation of machine 10 is inhibited (TERMINATE MACHINE OPERATION) until the exhausted cartridge is replaced. Presuming that the cartridges 12, 14, 16 have not reached the end of life (and that no other faults are found), the machine enters the standby state ready to make prints.

On a print request (PRINT REQUEST?), machine 10 cycles up and commences to make prints. Control unit 100 counts each time a finished print is detected by print sensor 85 as the finished print passes from fixing station 80 into output tray 86 (COUNT PRINTS MADE). When the print run is completed (LAST PRINT?) and the machine cycles down, the total number of images made during the run, i.e., the image run count, is temporarily stored in RAM 103 (STORE PRINT RUN COUNT IN MEMORY). Control unit 100 fetches the current image count from the EEPROM 90 of each cartridge 12, 14, 16 (FETCH PRINT COUNT FROM EEPROM) and, using the image run count from RAM 103, calculates a new current image count for each EEPROM 90 (CALCULATE NEW CARTRIDGE PRINT COUNT) reflecting the number of images remaining on the cartridge. Control unit 100 then writes the new current image count back into the individual EEPROMs 90 of each cartridge 12, 14, 16.

Prior to returning the new current image counts to EEPROMs 90, control unit 100 compares each new current image count against the warning count X stored in EEPROMs 90 of each cartridge 12, 14, 16. Where the new current image count is equal to or less than the warning count X (IS NEW COUNT≦x?), a message (ORDER REPLACEMENT CARTRIDGE) is displayed for the particular cartridge in the control panel message display window 88. This alerts the operator to the fact that the identified cartridge is about to expire and that a new replacement cartridge should be available.

The new current image count for each cartridge is also compared with the termination count, exemplified here by zero (IS NEW COUNT≦ZERO?). Where the current image count is equal to or less than zero for a cartridge, the cartridge is disabled and the message (END OF LIFE) for the cartridge is displayed in the message display window 88. Control unit 100 prevents further operation of machine 10 (TERMINATE MACHINE OPERATION) until the expired cartridge is replaced by a fresh cartridge.

Referring now to FIG. 4, when the current image count becomes equal to or less than zero, a permanent internal grounding circuit 91 is completed in the affected EEPROM 90. Circuit 91, when completed, effectively destroys the ability of the EEPROM 90 to function as a memory. Other ways of rendering the EEPROMs of cartridges 12, 14, and 16 inoperable when the maximum number of images warranted for the cartridge have been used up may be envisioned.

It will be understood that since the current image count is only calculated and compared with the termination count at the end of an image run when machine 10 is cycled down, it is possible for the total image count on a cartridge to exceed the maximum image count Y. This occurs in cases where the current image count on a cartridge is very close to zero at the start of a job run and the number of prints programmed for the job is greater than the number of images remaining on the cartridge. Rather than interrupt the job in midstream, cartridges 12, 14, 16 are designed with a safety factor enabling a number of additional images over and above the maximum number allowed to be made in this type of situation.

While the present invention has been disclosed as implemented by means of replaceable xerographic, developer, and toner cartridges, the invention is not limited to the number and types of cartridges disclosed but is instead equally well suited to any application in which one or more replaceable cartridges such as those described or other cartridges or replaceable modules are used. And while a decrementing type of counting system is disclosed, an incrementing type counting system may instead be used.

While the invention has been described with reference to the structure disclosed, it is not confined to the details set forth, but is intended to cover such modifications or changes as may come within the scope of the following claims.

We claim:

1. A monitor/warranty method for an electrostatographic reproducing machine having at least one replaceable cartridge warranted to produce a predetermined number of images, and an operating system for controlling operation of said machine including job programming means for programming image runs, said cartridge including an on-board memory for monitoring cartridge use, comprising the steps of:

(a) counting the images produced;

(b) accessing said cartridge memory to obtain a current image count of the number of images remaining on said cartridge and a predetermined termination image count reflecting the maximum number of images that can be produced by said cartridge;

(c) arithmetically updating said current image count with the count of images produced during said run;

(d) storing said updated current image count in said cartridge memory;

(e) comparing said updated current image count with said termination count; and (f) where said updated current image count is at least equal to said termination count, disabling said cartridge from further use.

2. The method according to claim 1 including the steps of:

(a) counting the images produced during each image run; and (b) performing steps b–f at the end of said image run.

3. The method according to claim 1 including the steps of:

(a) accessing said cartridge memory to obtain a warning count stored in said cartridge memory reflecting a predetermined number of images remaining prior to reaching said termination count;

(b) comparing said warning count with said updated current image count; and (c) when said warning count is at least equal to said updated current image count, signaling that said cartridge needs replacement.

4. The method according to claim 3 including the steps of:

(a) providing a cartridge recognition number in said machine operating system;

(b) prior to producing images, retrieving a cartridge identification number pre-programmed in said cartridge memory;

(c) comparing said cartridge identification number with said cartridge recognition number; and (c) where said comparison of said cartridge identification number with said cartridge recognition number indicates that said cartridge is incorrect, precluding operation of said machine with said cartridge.

5. The method according to claim 4 including the step of:

where said comparison of said cartridge identification number with said cartridge recognition number indicates that said cartridge is incorrect, signaling that said cartridge is the wrong cartridge.

6. A replaceable cartridge for a xerographic copying or printing machine for producing images comprising:

(a) a cartridge housing;

(b) at least one xerographic processing component operably disposed in said housing effective on assembly of said cartridge with said machine to enable said machine to process images; and (c) a programmable memory in said housing for logging the number of images made on said cartridge, said memory being pre-programmed with a cartridge identification number for comparison with a cartridge recognition number in said machine on assembly of said cartridge with said machine whereby to restrict operation of said machine to only authorized cartridges.

7. The cartridge according to claim 6 in which:

said memory is pre-programmed with a number reflecting the maximum number of images that can be made with said cartridge;

said memory including a circuit adapted when the number of images logged on said cartridge is a least equal to said number to disable said memory from further use.

8. The cartridge according to claim 7 in which said memory comprises an EEPROM.

9. A customer billing system for an electrostatographic copying or printing machine for producing images, said machine having an operating system for controlling operation of said machine, comprising, in combination:

(a) at least one replaceable cartridge for use in operating said machine, said cartridge having a limited operational life allowing said machine on installation of said cartridge to produce a preset number of images;

(b) said cartridge including a programmable memory for logging an image count of the number of images made on said cartridge;

(c) means for updating said image count in said memory as images are produced by said machine;

(d) said memory being pre-programmed with a maximum image count reflecting the maximum number of images that can be produced with said cartridge;

(e) said memory including means to permanently disable said memory from further use when the image count in said memory reaches said maximum image count, said operating system including means responsive to disabling of said memory to prevent said machine from producing images.

10. The system according to claim 9 in which (a) said memory is pre-programmed with a cartridge identification number;

(b) said operating system having a cartridge recognition number;

(c) said operating system prior to producing images comparing said cartridge identification number with said cartridge recognition number and preventing said machine from processing images in the absence of a predetermined correspondence between said numbers.

11. The system according to claim 10 in which said memory has a warning count corresponding to a preset number of images prior to said maximum image count;

said operating system generating a signal to replace said cartridge when the image count in said memory reaches said warning count.

12. The system according to claim 11 in which said memory comprises an EEPROM.

* * * * *